US006290628B1

(12) United States Patent
Wilkinson

(10) Patent No.: US 6,290,628 B1
(45) Date of Patent: Sep. 18, 2001

(54) AEROBIC CLIMBING STEP/BENCH DEVICE

(76) Inventor: William T. Wilkinson, Severnside Farm, 300 Kyle Rd., Crownsville, MD (US) 21032-0572

( * ) Notice: Subject to any disclaimer, the term of this patent is extended or adjusted under 35 U.S.C. 154(b) by 0 days.

(21) Appl. No.: 08/580,048

(22) Filed: Dec. 20, 1995

Related U.S. Application Data

(63) Continuation of application No. 08/128,642, filed on Sep. 30, 1993, now abandoned, which is a continuation of application No. 08/069,740, filed on Jun. 1, 1993, now Pat. No. 5,352,168, which is a continuation-in-part of application No. 07/891,178, filed on May 29, 1992, now Pat. No. 5,248,286, which is a division of application No. 07/718,754, filed on Jun. 21, 1991, now Pat. No. 5,118,096, which is a division of application No. 07/588,449, filed on Sep. 26, 1990, now abandoned, said application No. 08/069,740, is a continuation-in-part of application No. 07/967,711, filed on Oct. 28, 1992, now Pat. No. 5,275,579, which is a continuation-in-part of application No. 07/754,075, filed on Sep. 3, 1991, now Pat. No. 5,162,028, and a continuation-in-part of application No. 07/698,382, filed on May 10, 1991, now Pat. No. 5,184,987.

(51) Int. Cl.[7] ..... A63B 17/00
(52) U.S. Cl. ..... 482/52; 482/51; 248/188.8
(58) Field of Search ..... 482/52, 55, 51; 248/188.8, 188.2, 188.9; 297/423.45, 12, 144, 438, 439; 108/11, 12, 157–159

(56) References Cited

U.S. PATENT DOCUMENTS

| | | | | |
|---|---|---|---|---|
| 2,522,827 | * | 9/1950 | Kelley | 488/188 |
| 2,532,902 | * | 12/1950 | Greenway | 248/188 |
| 2,722,970 | * | 11/1955 | Stechmann | 248/188.2 |
| 3,164,351 | * | 1/1965 | Rembowski | 248/188.5 |
| 3,177,035 | * | 4/1965 | Halstrick | 248/188.2 |
| 3,964,404 | * | 6/1976 | Mueller et al. | 248/188 |
| 5,108,089 | * | 4/1992 | Wilkinson | 482/52 |
| 5,162,028 | * | 11/1992 | Wilkinson | 482/52 |
| 5,275,579 | * | 1/1994 | Wilkinson | 482/52 |
| 5,352,168 | * | 10/1994 | Wilkinson | 482/55 |

* cited by examiner

*Primary Examiner*—Jerome W. Donnelly
(74) *Attorney, Agent, or Firm*—Connolly Bove Ludge & Hutz LLP

(57) ABSTRACT

An aerobic climbing step/bench device includes a base in the form of a horizontal platform having a downwardly extending apron. Height adjustability is achieved by the use of detachable legs which are mounted to the base by mounting elements and complementary mounting elements on the legs and underside of the base. At least one set of mounting and complementary mounting elements includes a cylindrical post and a recess shaped to receive the post.

20 Claims, 3 Drawing Sheets

Fig. 13.
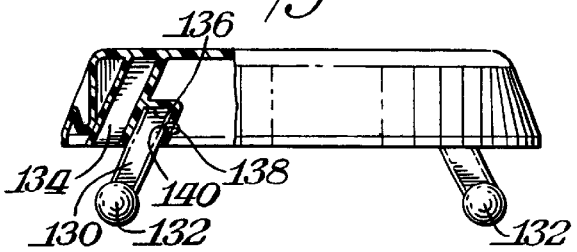
Fig. 14.
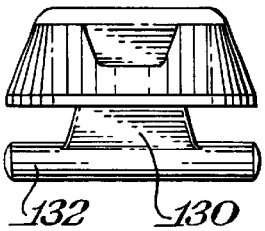
Fig. 15.
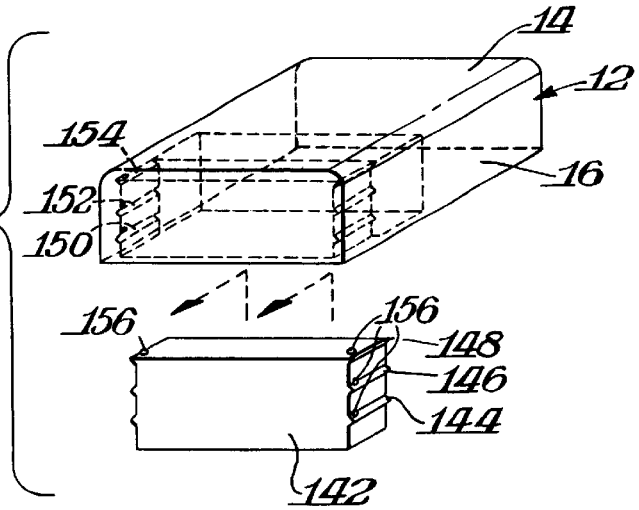
Fig. 16.
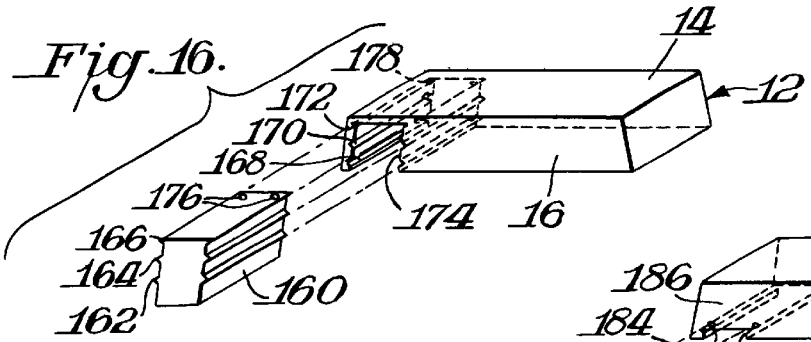
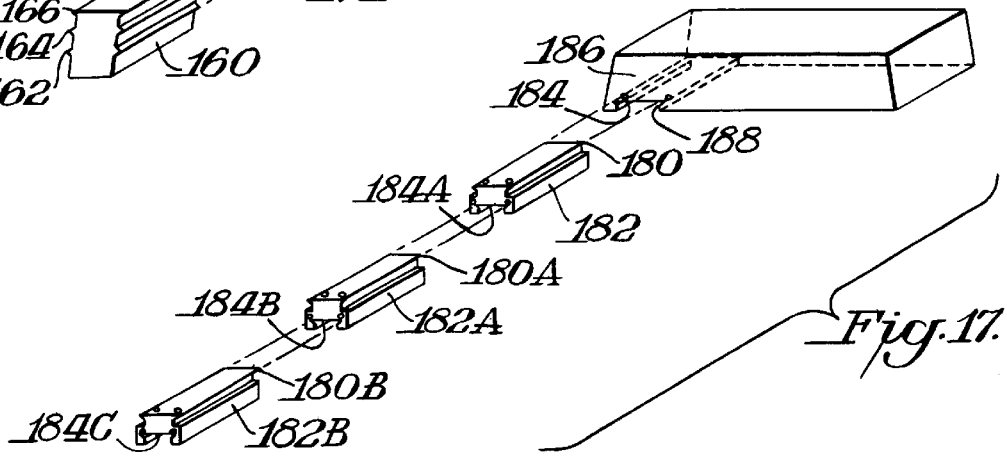
Fig. 17.

AEROBIC CLIMBING STEP/BENCH DEVICE

CROSS-REFERENCE TO RELATED APPLICATIONS

This application is a continuation, of application Ser. No. 08/128,642 filed on Sep. 30, 1993 now abandoned.

This application is a continuation of application Ser. No. 08/069,740 filed Jun. 1, 1993 now U.S. Pat. No. 5,352,168 which in turn is a continuation-in-part of application Ser. No. 07/891,178 filed May 29, 1992, now U.S. Pat. No. 5,248,286, which in turn is a division of application Ser. No. 07/718,754 filed Jun. 21, 1991, now U.S. Pat. No. 5,118,096 and which is a division of application Ser. No. 07/588,449 filed Sep. 26, 1990, now abandoned. Application Ser. No. 08/069,740 is also a continuation-in-part of application Ser. No. 07/967,711 filed Oct. 28, 1992, now U.S. Pat. No. 5,275,579, which in turn is a continuation-in-part of application Ser. No. 07/754,075 filed Sep. 3, 1991, now U.S. Pat. No. 5,162,028 and a continuation-in-part of application Ser. No. 07/698,382 filed May 10, 1991, now U.S. Pat. No. 5,184,987.

BACKGROUND OF THE INVENTION

Various forms of aerobic exercise are intended to develop different parts of the body. It would be desirable if the aerobic exercise could be supplemented by the user stepping up to and down from a horizontal platform. It would also be desirable if the height of the platform could be selectively adjusted to meet the individual needs of the user.

Various patents exist in the name of co-applicant William T. Wilkinson relating to adjustable steps. The prior art versions generally involve a fixed pair of supports wherein the platform or step itself is adjusted in height in accordance with the specific mounting of the step to the supports.

U.S. Pat. No. 5,158,512 relates to an adjustable step in which a platform is provided with a plurality of detachable support elements to provide height adjustability in accordance with the number of support elements used. There is no suggestion, however, of using the platform alone as the lowest height level.

SUMMARY OF THE INVENTION

An object of this invention is to provide an aerobic climbing step/bench device wherein the height adjustability is achieved by means of a detachably mounted leg assembly.

In accordance with this invention one height level could be achieved by providing an exercise step having a base and a plurality of legs. The uppermost portion of the base is substantially horizontal and planar to comprise a stepping platform. The base also includes an apron extending downwardly and terminating in a lowermost portion which is substantially horizontal and planar and parallel to the platform. Each leg has a lowermost portion which is also substantially horizontal and planar. Mounting means and complementary mounting means are provided on the base and legs or vice versa for the detachable engagement of the legs to the base. As a result, the platform has a first substantially horizontal height level when the base is placed directly on a support surface such as the floor. The platform has a second higher height level when a set of the legs is mounted to the base and the legs is placed directly on the support surface or floor.

Various means may be utilized for detachably mounting the leg assembly to the platform. Additionally, multiple sets of legs and multiple mounting means and complementary mounting means may be used to achieve additional possible height levels. Preferably at least one set of mounting means includes a cylindrical post and a recess shaped to receive the post.

THE DRAWINGS:

FIG. 13 is a side elevational view partly in section of yet another form of exercise step usable in this invention;

FIG. 14 is an end elevational view of the exercise step used in FIG. 13; and FIGS. 15–18 are exploded perspective views of yet further forms of exercise steps usable in accordance with this invention.

DETAILED DESCRIPTION

Figure 1:
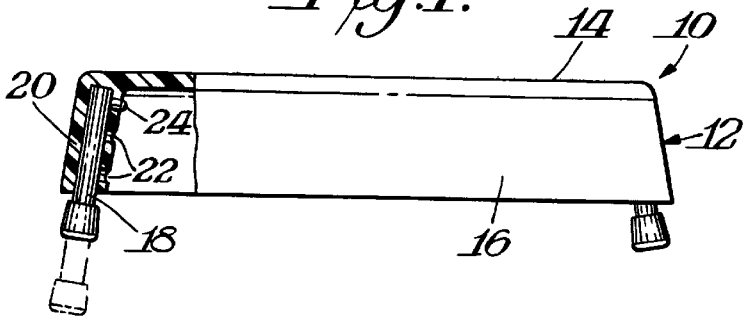
FIG. 1 is a side view in elevation and partly in section of an exercise step usable in this invention.

The present invention relates to the attaining of height adjustability for an exercise step so that the user could perform an exercise by repeatedly stepping up onto and down from the step after the specific height adjustability has been selected. In the preferred practice of this invention the stepping up and down, to and from the step is done in conjunction with an aerobic exercise of any suitable type as is known in the exercise art.

The present application is directed to various manners of achieving the height adjustability in accordance with techniques disclosed in various parent applications and patents. These techniques, in general, include having the leg assembly mounted to the base to directly contact and support the base at a plurality of spaced locations. The leg assembly may include a plurality of individual legs and the individual legs may be mounted at the spaced locations.

The base may be of rectangular shape and have a pair of elongated sides interconnected at the corners by a pair of ends with at least one leg mounted generally at each of the pair of ends. If desired, a leg may be mounted at each corner or the leg may extend generally from one side of the ends to the other.

The mounting means may comprise recesses and the complementary mounting means may comprise projections which are inserted into the recesses.

The leg assembly may comprise a plurality of individual legs each of which is mounted to the base. Each leg may terminate in an upper end which comprises the projection and the recesses may be in the base. The legs would be mounted by inserting the upper end of each leg into a respective recess.

Each leg may have an extended portion which comprises the projection with the recesses being located in the base. The legs may be mounted by inserting the extended portion of each leg into a respective recess. The projections may be in the base or in the leg assembly or conversely the recesses may be in the base or in the leg assembly.

The apron may extend around the periphery of the base with the base being hollow in the portion of the base in the periphery of the apron so that the periphery of the apron comprises the projections which in turn are inserted into recesses of the leg assembly. The periphery may be continuous and unbroken or may be located at spaced portions extending from the base.

There may be plural sets of recesses of different effective lengths and plural height levels could be obtained in accordance with which set of the recesses is selected for insertion of the projections. Conversely, there may be plural sets of projections of differing lengths and a further height level may be selected in accordance with which set of projections is inserted into the recesses.

The recesses may be in the base and leg assembly may comprise a plurality of elongated legs each of which has a central portion and an opposite portion of lesser maximum width than the central portion. The opposite ends of each leg may comprise extensions of differing lengths.

The recesses may be holes and the projections posts inserted into the holes. Alteratively, the recesses may be tracks and the projections may be rails which slide in the tracks. Still further, the recesses may be in the form of channels.

Additional height adjustability may be achieved by providing a second leg assembly having mounting means complementary to the mounting means of the first leg assembly so that the second leg assembly could be mounted to the first leg assembly and the first leg assembly mounted to the base. Alternatively, a second leg assembly may be provided of differing heights than the first leg assembly and the additional height level may be obtained in accordance with which of the leg assemblies is mounted to the base. Still further, each of the legs in the leg assembly may have two orientations whereby the length of the leg differs in accordance with which of the orientations is selected for mounting the leg to the base.

FIG. 1 illustrates an exercise step 10 in accordance with one practice of the method of this invention. As shown therein the arrangement of FIG. 1 as well as the arrangements of FIGS. 2–8 are described in parent Pat. No. 5,162,028 the details of which are incorporated herein by reference thereto. In the embodiment of FIG. 1 the step 10 includes a base 12 in the form of a horizontal platform 14 and a downwardly extending apron 16. Height adjustability is achieved by providing a plurality of legs 18 each of which would be inserted into a respective pocket 20 at each corner of base 12. Pocket 20 would have a series of holes 22 which selectively receive a spring biased pin 24 on leg 18 to lock legs 18 in place.

With the arrangement of FIG. 1 the method may be practiced by obtaining a first height level when the legs 18 are completely detached and the lowermost portion of apron 16 contacts the support surface or floor. Further height levels could be achieved by mounting legs 18 to base 12 in accordance with which of the holes 22 pin 24 engages. The right-hand portion of FIG. 1 illustrates a lower level of height adjustability as is also shown in solid in the left-hand portion of FIG. 1 while the phantom showing in the left-hand portion of FIG. 1 illustrates the maximum height adjustability.

Figure 2:
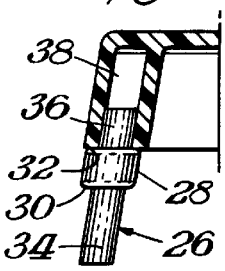
FIGS. 2–6 are cross-sectional views in elevation of alternative views of exercise steps used in accordance with this invention.

FIG. 2 illustrates a further method of achieving height adjustability. As shown therein a leg 26 includes an enlarged off-center extension 28 having shoulders 30,32 so that a narrow portion 34 or 36 is on each side of a respective shoulder. The step device includes a pocket 38 for receiving a leg 26.

When leg 26 is inserted the respective shoulder 30 or 32 limits the amount of extension. Thus, achieving different height adjustments in accordance with the orientation of leg 26.

Figure 3:
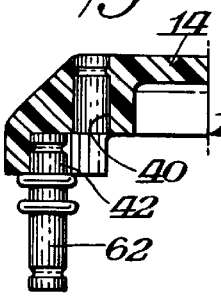

FIG. 3 illustrates yet another form of height adjustability wherein the base 12 includes a pair of pockets or channels 40,42 displaced from each other located a different distance from the upper surface of platform 14. Leg 62 would be inserted into one of the pockets 40,42 to achieve height adjustability.

Figure 4:
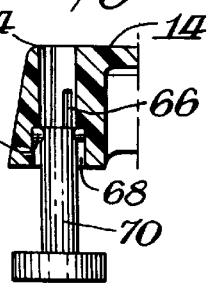

FIG. 4 illustrates yet another manner of achieving height adjustability wherein the base 12 includes pocket 64 having a set of slots 66,68 extending different lengths. The leg 70 has corresponding pins 72 for fitting in the slots. When pins 72 are inserted in the slots 68, one height adjustability is achieved. When pins 72 are inserted in longer slots 66 a smaller height adjustability is achieved.

Figure 5:
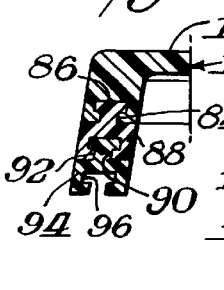

FIG. 5 illustrates yet another manner of height adjustability wherein the base 12 has an opening 54 shaped to receive extension 86 of leg 88. Leg 88 in turn has a similar opening 90 shaped for receiving extension 92 of further leg 94. Leg 94 in turn has an opening 96 of similar shape to openings 84 and 90 for receiving yet another leg and so forth.

Figure 6:
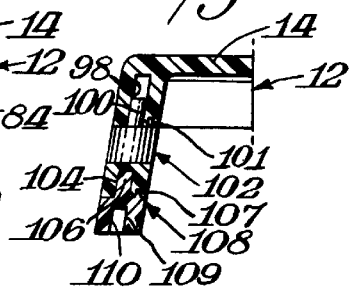

FIG. 6 illustrates a method for achieving height adjustability wherein the base 12 has an opening 98 for receiving the extension 100 of leg 102. Leg 102 has a similar opening 104 for receiving extension 106 of leg 108. Leg 108 in turn has an opening 110 for receiving a further leg and so on. Pins 101 on leg 102 fit in holes in the apron similar to holes 109 of leg 108. Similarly, pins 107 on leg 108 fit into holes in leg 102.

Figure 7:
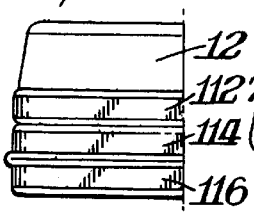
FIG. 7 is a side elevational view of yet another form of exercise step usable with this invention.

FIG. 7 illustrates yet another manner of achieving height adjustability wherein a series of legs or spacers 112,114,116 etc. may be secured together by interlocking or any other fashion and then selectively secured to base 12. If desired, the legs or spacers may also be in the form of interconnected or separate mats.

Figure 8:
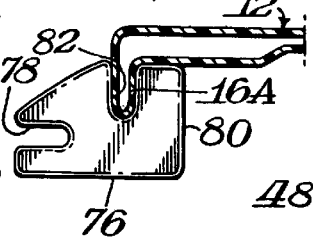
FIGS. 8–11 are side views partly in section of yet other forms of exercise steps used in accordance with this invention.

FIG. 8 illustrates a form of achieving height adjustability wherein the leg 74 is of block form and includes a long side 76 having a parallel slot 78 and a shorter side 80 having a parallel slot 82. Leg 74 is mounted to base 12 by selectively fitting the apron 16A into a respective slot 78 or 82.

Figure 9:
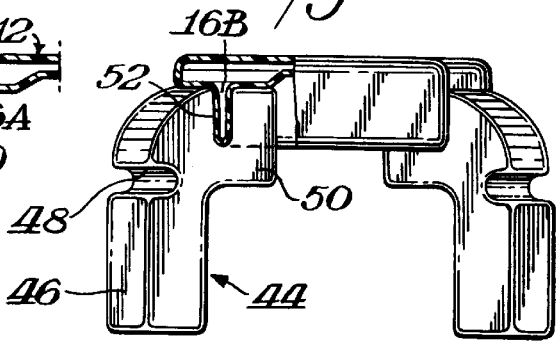
Figure 10:
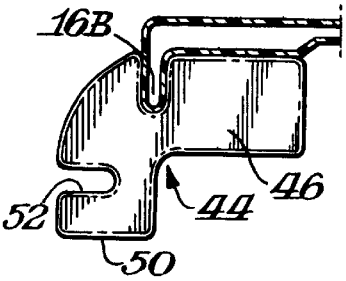

The embodiment of FIG. 8 as well as the embodiments of FIGS. 9–10 is also described in parent U.S. Pat. No. 5,116,044, the details of which are incorporated herein by reference thereto.

As shown in FIGS. 9–10 height adjustability is achieved by providing a leg 44 with a long extension 46 having a recess 48 and a shorter extension 50 having a recess 52. The height adjustability would depend upon which of the recesses 48 or 52 is utilized for insertion of the apron 16B. Thus, FIG. 9 illustrates a height adjustability which is greater than that shown in FIG. 10.

Figure 11:
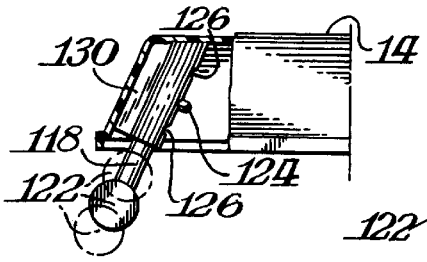
Figure 12:
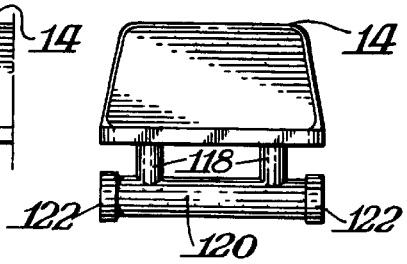
FIG. 12 is an end elevational view of the exercise step shown in FIG. 11.

FIGS. 11–12 show an arrangement similar in operation to that of FIG. 1, but having the structure described in U.S. Pat. No. 5,108,089, the details of which are incorporated herein by reference thereto. As shown in FIGS. 11–12 the leg assembly comprises a pair of legs 118,118 at each end of the base 12 interly connected to each other by a single foot 120 having non-slip end caps 122,122. This embodiment illustrates that the legs may not need to be secured to the corners of base 12. In operation, the height adjustability would be achieved in accordance with spring pin 124 being selectively engaged in a corresponding hole 126 provided in pocket or channel 130 in apron 14.

FIGS. 13–14 illustrates another practice of the invention which is described in greater detail in U.S. Pat. No. 5,108, 089 the details of which are incorporated herein by reference thereto. As shown therein, a single wide leg 130 is provided at each end of base 12. Elongated foot 132 is integral with legs 130. FIG. 13 best illustrates the manner of mounting the legs 130 to provide height adjustability. As shown therein, at least two side by side slots or channels 134,136 are integrally formed on apron 16. The channels are made of differing lengths. For example, when leg 130 is inserted completely into long channel 134 it will elevate the platform to a level above that obtained when the base is mounted directly on the support surface or floor and no legs are used. Thus, the first height levels is obtained when no leg assembly is mounted to base 12. A second height level is obtained when legs 130 are inserted into long channel 134 and a third height level is obtained when legs 130 are inserted into short channels 136. Each leg may be mounted in its respective channel by a spring pin 138 extending into an appropriate opening 140. It should be understood that this form of mounting could be done with other leg structures and not necessarily a single leg at each end. Thus, individual legs may be mounted at a plurality of locations such as in the four corners.

The embodiments illustrated in FIG. 15–18 are described in greater detail in parent Pat. No. 5,184,987 the details of which are incorporated herein by reference thereto.

FIG. 15 illustrates an embodiment wherein the apron 16 may extend completely around the periphery of platform 15 or may extend only in areas where support is needed. As shown in FIG. 15 height adjustability is achieved through a pair of steps 142 only one of which is illustrated. The other step would be of identical construction. Step 142 is provided with a series of vertically displaced mounting elements or rails 144,146,148 on each side thereof. In the illustrated embodiment the mounting elements are in the form of ridges or tongues which fit into corresponding grooves or tracks on opposite sides 152,154 on the inner surface of apron 16. One set of such grooves or tracks is illustrated at one end of apron 16 and the second set would be provided at the other end of apron 16. Each leg 142 is of a length which is no greater than ⅓the length of base 12 so that the corresponding tracks 150,152,154 could extend at each end of apron 16 and occupy about ⅓of its length in each location. Thus a central portion of apron 16 is free of tracks so that each leg may be mounted to base 12 by being inserted upwardly in the central portion of the base between the opposite sides of apron 16. Base 12 is preferably inverted to permit the legs to be mounted. Alternatively, base 12 could be raised without inversion and each leg sequentially moved vertically into the trackless central portion of apron 16. Each leg 142 would then be moved outwardly toward the outer end of platform 14 with the various ridges engaged in complementary tracks of base 12. Preferably, each ridge is provided with a nub or dimple 156 which would fit in a corresponding notch 158. Its respective track to lock the leg in place when the leg is disposed against its most outward position. It is to be understood that any number of legs may be mounted to base 12 in this manner.

FIG. 16 illustrates a variation of the invention wherein the legs 160 are first mounted rather than being inserted in the center of base 12 and then they move outwardly in the manner described with respect to FIG. 15. As illustrated in FIG. 16, legs 160 include ridges or rails 162,164,166 which engage complementary tracks 168,170,172 along the surface of apron 16 and inner apron 174. Inner apron 174 in this embodiment is a wall parallel to one of the walls of apron 16 so that the leg 116 may be inserted by being slid through the open area in the front wall of apron 16 with the corresponding ridges engaged in complementary tracks. A second inner apron and mounting element would be at the opposite side of the base 12 along with a second opening in front of the apron. When fully inserted leg 160 is locked in place by projections 176 entering corresponding notches in the complementary tracks.

FIG. 17 illustrates a further variation of this invention wherein height adjustability is achieved by having a single sets of fastening elements such as ridges 180 on legs 182. Ridges 180 engage in corresponding tracks 184 provided in outer apron 186 and inner wall 188. Leg 182 would be front mounted in the manner similar to leg 160 except that there is no selectivity in height adjustment of leg 182. In this respect, there is only a single set of tracks and a single set of ridges. Height adjustment is achieved by providing further legs 182A, 182B etc. each of which has a set of ridges 180A, 180B etc. for engagement in complementary tracks 184A, 184B, 184C etc. which selectively permit any number of legs to be vertically connected together. For example, as illustrated lower leg 182B includes a track 184C for receiving yet another leg. It is to be understood that although the various figures illustrate only a single leg mounted to the respective base the invention would be practiced by having legs at at least two spaced locations, preferably at the opposite ends of the base.

Figure 18:
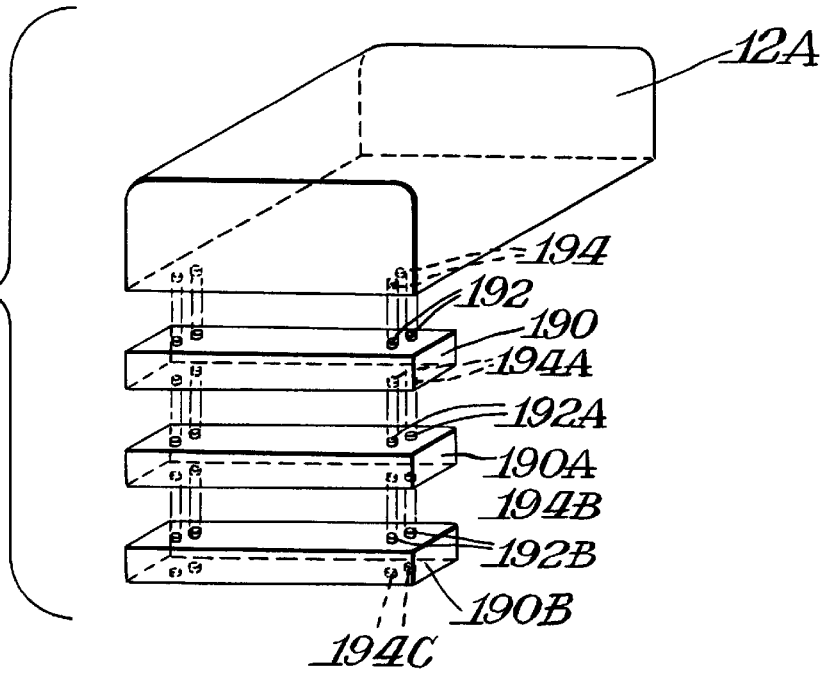

FIG. 18 illustrates yet another variation of the invention wherein the legs are in the form of identical block members 190. Each block 190 includes a set of posts 192. Base 12A may be formed of solid block construction and its lower surface would be provided with a set of holes 194 positioned for snugly receiving posts 192 for the uppermost leg 190. Each leg in turn is provided with holes 194A, 194B, 194C etc. at its lower surface for receiving the posts 192A, 192B, etc. of the next adjacent lower leg 190A, 190B, etc. This manner of height adjustment is particularly advantageous since the interlocking of the post and holes provides a positive support structure which would prevent any accidental dislodgement of legs by someone inadvertently, for example, kicking the assembly.

Parent U.S. Pat. No. 5,184,987 and FIG. 18 illustrate the posts to be of cylindrical shape and the recesses or holes being shaped to receive the posts. Parent U.S. Pat. No. 5,184,987 also discloses the inclusion of nonskid members to be provided on the surface contacting edges of the apron and legs.

If desired, base 12A may be of solid block construction only in the areas where the base is secured to the base.

It is to be understood that the various features illustrated with respect to individual embodiments may be used with other embodiments and that the specifically illustrated and described embodiments are merely for exemplary purposes to describe step structures that may be used in practicing the invention. It is also to be understood that as used herein the term leg assembly is intended to include a plurality of legs or a single leg having contact with the base over a sufficient area to provide support. The reference herein to spaced locations is intended to mean that the contact or support for the base takes place over a sufficiently broad area which would include more than a single location so that there is sufficient support for the base.

When prior patents are referred to wherein the disclosures are incorporated herein by reference thereto, such reference thereto is intended to include all embodiments of those patents including embodiments not specifically described or illustrated herein.

What is claimed is:

1. An aerobic step device comprising a base consisting of a generally planar platform having a periphery formed by opposite ends and intermediate sides and a bottom surface, a foot at each of said ends to comprise a set of feet for elevating said platform, each of said feet having an upper end and a lower end, each of said feet generally extending completely across its said end of said base, said lower end of each of said feet terminating in a floor contacting surface disposed below said base with said feet extending downwardly below said base, each of said feet being movably mounted to said base by mounting elements and at least one complementary mounting element, said mounting elements comprising a set of vertically spaced receiving members at each of said ends of said base and secured to one of said foot and said base, said complementary mounting element being a lock member at each of said ends of said base movably mounted to the other of said foot and said base, and said lock member being selectively engageable in said receiving members to control the degree of extension of said foot outwardly from said base in accordance with which of said receiving members is engaged by said lock members for providing a plurality of height adjustments of said platform.

2. The device of claim 1 wherein each of said feet generally extends completely across its said end of said base.

3. The device of claim 2 wherein said platform is horizontal and parallel to said floor contacting surfaces of said feet when said feet are extended from said base by the same distance as each other.

4. The device of claim 3 wherein each of said floor contacting surfaces is covered with a non-slip material.

5. The device of claim 1 wherein said lock member is selectively disengageable from said receiving members by a pushing force against said lock member.

6. An aerobic step device comprising a base consisting of a generally planar platform having a periphery formed by opposite ends and intermediate sides and a bottom surface, a foot at each of said ends to comprise a set of feet for elevating said platform, each of said feet having an upper end and a lower end, said lower end of each of said feet terminating in a floor contacting surface disposed below said base with said feet extending downwardly below said base, each of said feet being movably mounted to said base by mounting elements and at least one complementary mounting element, said mounting elements comprising a set of vertically spaced receiving members at each of said ends of said base and secured to one of said foot and said base, said complementary mounting element being a lock member at each of said ends of said base movably mounted to the other of said foot and said base, said lock member being selectively engageable in said receiving members to control the degree of extension of said foot outwardly from said base in accordance with which of said receiving members is engaged by said lock members for providing a plurality of height adjustments of said platform, said lock member is selectively disengageable from said receiving members by a pushing force against said lock member.

7. The device of claim 6 wherein the disengaging pushing force is from a direction inwardly of and toward the respective end of said base at which said foot is mounted.

8. The device of claim 1 wherein said platform is horizontal and parallel to said floor contacting surfaces of said feet when said feet are extended from said base by the same distance as each other.

9. The device of claim 1 wherein each of said floor contacting surfaces is covered with a non-slip material.

10. The device of claim 1 wherein said receiving members are secured to said base.

11. The device of claim 3 wherein said receiving members are holes in a channel secured to said base.

12. The device of claim 11 wherein said lock member is a spring pin secured to said foot.

13. The device of claim 12 wherein each of said feet includes a pair of legs each of which is telescoped into a respective one of said channels, a spring pin being on each of said legs, and a set of said holes being in each of said channels.

14. The device of claim 7 wherein said lock member is mounted to said foot.

15. The device of claim 1 wherein each of said feet is completely detachable from said base.

16. The device of claim 1 wherein each of said feet includes an intermediate structure extending into the periphery of the base with the floor contacting surface of each of said feet extending outwardly beyond said intermediate structure at both sides of the intermediate structure, and said intermediate structure being selectively movable further into and out of the periphery of said base during the height level selection.

17. The device of claim 16 wherein said floor contacting surface of said feet terminates generally in line with said periphery of said base, and said floor contacting surface being generally juxtaposed and below said periphery of said base when the lowest height level is selected.

18. The device of claim 2 wherein each of said feet includes an intermediate structure extending into said periphery of said base with said floor contacting surface of each of said feet extending outwardly beyond said intermediate structure at both sides of said intermediate structure, and said intermediate structure being selectively movable further into and out of said periphery of said base during the height level selection.

19. The device of claim 18 wherein said floor contacting surface of said feet terminates generally in line with said periphery of said base, and said floor contacting surface being generally juxtaposed and below said periphery of said base when the lowest height level is selected.

20. The device of claim 5 wherein the disengaging pushing force is from a direction inwardly of and toward the respective end of said base at which said foot is mounted.

* * * * *